US006007114A

United States Patent [19]

Hötzl

[11] Patent Number: 6,007,114

[45] **Date of Patent: *Dec. 28, 1999**

[54] LATCH-OPERABLE MULTIBOLT LOCK

[75] Inventor: Manfred Hötzl, Graz, Austria

[73] Assignee: Roto Frank Eisenwarenfabrik AG, Karlsdorf Bei Graz, Austria

[ * ] Notice: This patent issued on a continued prosecution application filed under 37 CFR 1.53(d), and is subject to the twenty year patent term provisions of 35 U.S.C. 154(a)(2).

[21] Appl. No.: 08/860,945

[22] PCT Filed: Dec. 21, 1995

[86] PCT No.: PCT/AT95/00249

§ 371 Date: Jul. 29, 1997

§ 102(e) Date: Jul. 29, 1997

[87] PCT Pub. No.: WO96/19630

PCT Pub. Date: Jun. 27, 1996

[30] Foreign Application Priority Data

Dec. 21, 1994 [AT] Austria ..... 2377/94

[51] Int. Cl.[6] ..... E05C 1/06

[52] U.S. Cl. ..... 292/34; 292/165; 292/40; 292/DIG. 60

[58] Field of Search ..... 292/336.3, 34, 292/46, 165, 178, 147, 204, DIG. 24, 40, 52, DIG. 21, DIG. 62, 66, 71, 74, 75, 169, 167, DIG. 60

[56] References Cited

U.S. PATENT DOCUMENTS

| | | | |
|---|---|---|---|
| 2,101,746 | 12/1937 | Manfredi | 292/74 X |
| 2,650,121 | 8/1953 | Schlage | 292/167 |
| 3,582,119 | 6/1971 | Woodworth | 292/34 |
| 4,446,707 | 5/1984 | Mullich et al. | 292/DIG. 60 |

FOREIGN PATENT DOCUMENTS

| | | | |
|---|---|---|---|
| 0 509 217 A1 | 10/1992 | European Pat. Off. . | |
| 2 678 671 | 1/1993 | France . | |
| 605 681 | 10/1934 | Germany . | |
| 617699 | 8/1935 | Germany | 292/165 |
| 901 509 | 5/1953 | Germany . | |
| 1 062 143 | 7/1959 | Germany . | |
| 2909299 | 9/1980 | Germany | 292/336.3 |
| 91 07 714 U | 10/1991 | Germany . | |
| 40 41 537 A1 | 6/1992 | Germany . | |
| 567531 | 10/1957 | Italy | 292/336.3 |
| 78 07 082 | 1/1980 | Netherlands . | |
| 2 115 055 | 9/1983 | United Kingdom . | |

*Primary Examiner*—Darnell M. Boucher
*Attorney, Agent, or Firm*—Herbert Dubno; Andrew Wilford

[57] ABSTRACT

A lock has an actuating nut rotatable about an axis and formed with a radially extending guide, a bolt-controlling push rod slidable offset from the axis in a predetermined direction transverse to the axis, and a slide displaceable radially of the axis in the guide and having an outer end remote from the axis. A pin is engaged between the outer end of the slide and the push rod so that on rotation of the nut about the axis the slide and pin move angularly relative to the axis and the slide moves radially relative to the axis. The guide is a groove formed in the nut and he push rod is formed with a hole receiving the pin and the pin is fixed on the outer end of the slide.

6 Claims, 2 Drawing Sheets

LATCH-OPERABLE MULTIBOLT LOCK

CROSS REFERENCE TO RELATED APPLICATIONS

This application is the U.S. national phase of PCT application PCT/AT95/00249 filed Dec. 21, 1995 with a claim to the priority of Austrian application 23377/94 itself filed Dec. 21, 1994.

FIELD OF THE INVENTION

The invention relates to a latch-operable multibolt lock having a nut with a square recess for a latch or the like and with a kinematic connection to a least one push rod controlling a bolt.

BACKGROUND OF THE INVENTION

The bolts of multibolt locks are either pushed in and out by means of a lock cylinder with the assistance of the pertaining key or by turning a latch from a normal horizontal position upwards for locking and downwards for unlocking. The latter latch-operable multibolt locks have gears between the nut and the push rod or rods, whereby one model uses space-saving gear segments for reasons of space economy. The cost of these models is high and it is difficult to achieve high efficiency with small overall dimensions. A multitude of toothed connections leads to a play which has a negative effect on the operation of the multibolt lock.

OBJECTS OF THE INVENTION

It is the object of the invention to create a latch-operable multibolt lock, whose kinematics between the latch nut and the push rod is simple, saves space and is highly efficient.

SUMMARY OF THE INVENTION

This is achieved in that the nut is connected via a catch to a lever whose rotary motion is converted into a linear motion for the push rod, by means of a guide slot and a pin. Thereby it is suitable when the lever is built as a single-armed lever having a slot arranged in the longitudinal direction of the lever, wherein a slider is movably fitted, and when the slider bears on the pin which is rotatably supported in a bore of the push rod or of a push rod connection piece. In a technical reversal, the slot with the slider can also be provided in the push rod connection piece. The pin of the slider engages then in a bore on the frontal end of the single-armed lever. A concrete and advantageous embodiment is characterized in that the single-armed lever can be pivoted by approximately 45° from a basic position which is perpendicular to the sliding direction of the push rod, and a pushing motion of the push rod, respectively rods, results in a locked position and from that an unlocked position. This construction allows for high torque to be transmitted to the push rods in a limited space, and thereby for creature of free spaces for catches and bolt constructions, as well as for locking mechanisms with lock cylinders as well as nut openings and panic functions. For this purpose it is particularly suitable when the slider in the slot is designed as an elongated slide bar which can be telescopically pushed out of the slot, and when the pin is provided on the radially outer end of the slider.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
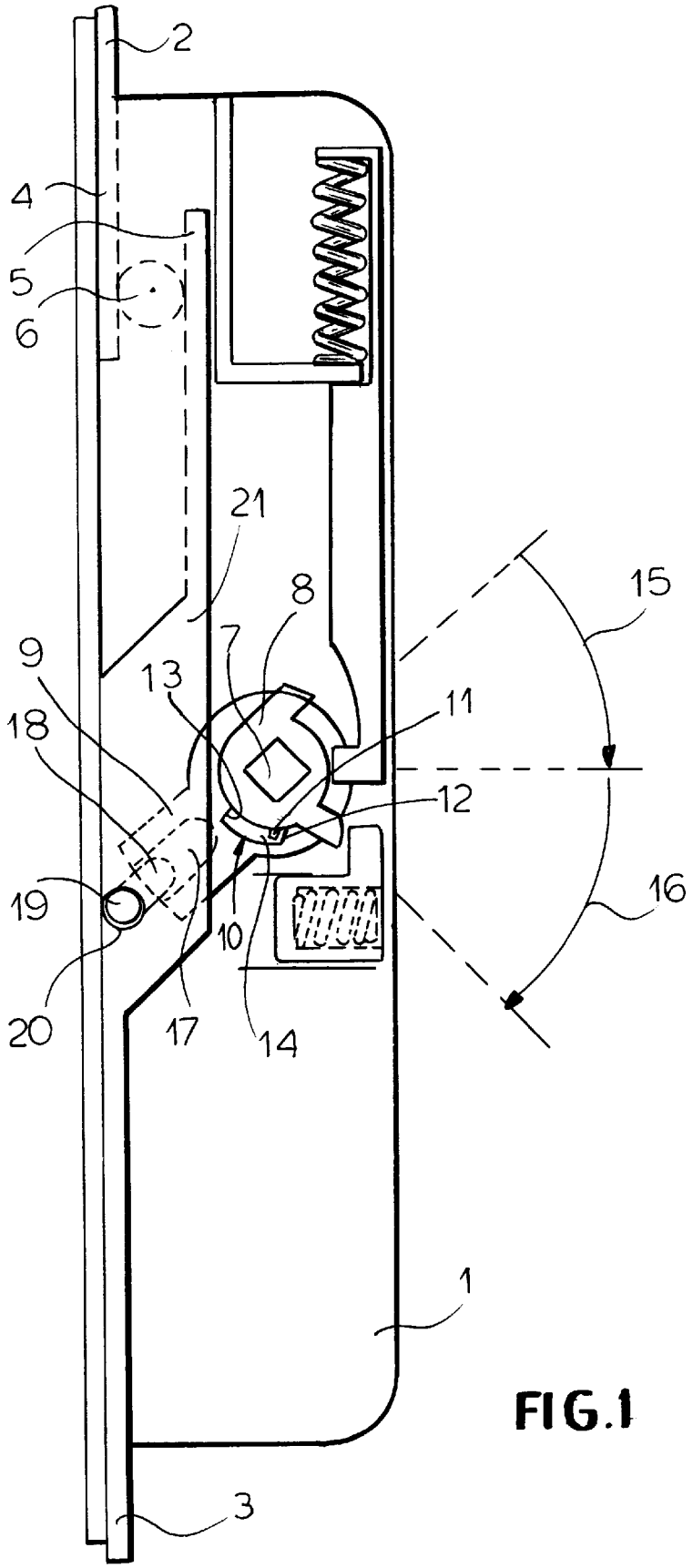
FIG. 1 is a side view of a multibolt lock according to the invention.

According to FIG. 1 in a lock housing 1 two push rods 2, 3 are slidably supported. A spreading gearing with the pinion 6 causes the opposite sliding directions of the push rods 2, 3. These push rods 2, 3 actuate several bolts, not shown in the drawing, via gear/rack gearing or coulisse actuation.

Figure 2:
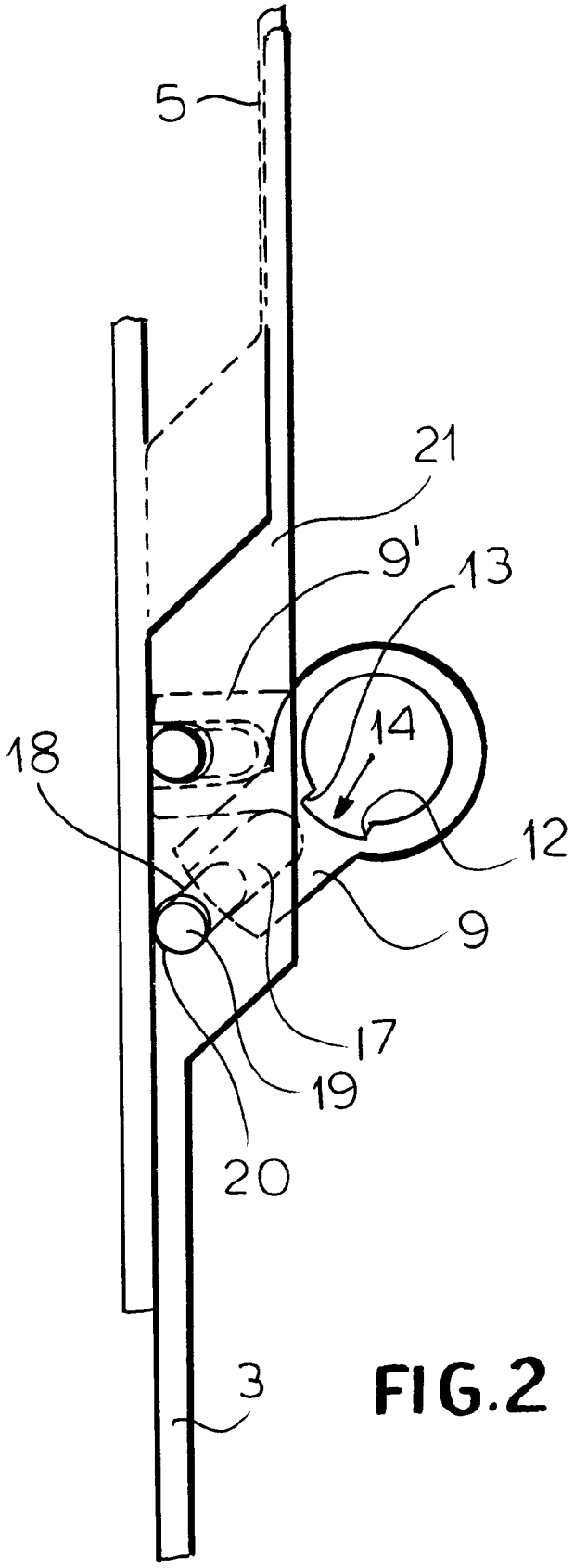
FIG. 2 is a detail of FIG. 1.

The displacement of the push rods 2, 3 takes place via an inner or outer latch whose mandrel engages with a positive lock in a square opening 7 of the nut 8. Coaxially with the nut 8 a lever 9 is supported, which over a catch 10 participates in an up and down latch motion, but which with respect to the reverse rotation of the latch caused or assisted by spring force, is released in the basic, respective the middle position of the latch. The catch 10 is here designed as a nose 11 formed on the nut 8, which engages between two catch surfaces 12, 13 of a groove 14. When the latch is rotated back, thereby rotating back the nut 8 in the sense of arrow 15, the lever 9 is released. The lever 9 does not participate in this motion, but is only then pushed back into the position 9' (FIG. 2), when the latch is pushed downward (Arrow 16).

The lever 9 has a slot 17, in which a slider 18 is movably supported. At its outer end, seen in radial direction, the latter has a pin 19 which engages in a bore 20, located close to the rail wall of the lock housing 1, of a push rod connecting slider 21. The position of the construction elements shown in FIG. 1 corresponds to the locked position of the multibolt lock, the position shown in FIG. 2 by the position 9' of the lever corresponds to the open position of the multibolt lock. The slider has the shape of a parallelepiped rounded on both sides at its frontal surfaces, which rests with its lateral surfaces against the lateral guide surfaces of the slot 17. During the rotation of the lever 9 into and out of the position 9' (FIG. 2) the slider 18 moves in the slot 17 radially inwards, or outwards. The pin 20 has a circular cross section and turns in the bore 20 during the motion of the lever. The push rod connector 21 performs a linear motion during the rotation of the lever 9 into the locked position, respectively out of the latter into the unlocked position of the multibolt lock.

The slot 17 can be closed at the bottom and this way designed as a groove, and if needed with dove-tail guidance. Further it is possible to simplify the construction by rigidly fastening the pin 19 to the push rod connector 21 and having it engage directly in the slot 17. However in this case a reduced lift results, compared to FIG. 1, because then the pin 19 has to be located closer to the rotation axis of the lever 9, in order to be contained within the slot. The slide 18 acts as a slide bar and in the construction of the invention prolongs the lever 9 somewhat telescopically, thereby creating particularly favorable kinematic conditions.

I claim:

1. A lock comprising:

an actuating nut rotatable about an axis and formed with a radially extending guide;

a bolt-controlling push rod slidable offset from the axis in a predetermined direction transverse to the axis;

a slide displaceable substantially only radially of the axis in the guide between an outer position projecting radially from the guide and an inner position, forming a radially telescoping extension of the guide, and having an outer end remote from the axis and lying radially outward of the nut and guide in the outer position; and a pin engaged between the outer end of the slide and the push rod and lying radially outward of the guide and nut in the outer position of the slide, whereby on rotation of the nut about the axis the slide and pin move angularly relative to the axis and the slide moves radially relative to the axis.

2. The lock defined in claim 1 wherein the guide is a groove formed in the nut.

3. The lock defined in claim 1 wherein the push rod is formed with a hole receiving the pin and the pin is fixed on the outer end of the slide.

4. The lock defined in claim 1 wherein the nut comprises a core part with a noncircular hole at the axis and an outer part rotatable relative to the core part and formed with the guide, the lock further comprising:

a lost-motion coupling between the core and outer part permitting only limited relative rotation of the two parts.

5. The lock defined in claim 1 wherein the slide has an outer ends that is radially inward of the guide outer end in the inner position.

6. A The lock defined in claim 5 wherein the pin is attached to the slide outer end.

* * * * *